US009597774B2

(12) United States Patent
Twersky et al.

(10) Patent No.: US 9,597,774 B2
(45) Date of Patent: Mar. 21, 2017

(54) CUBIC BORON NITRIDE COMPACTS

(75) Inventors: Anton Raoul Twersky, Johannesburg (ZA); Nedret Can, Boksburg (ZA)

(73) Assignee: ELEMENT SIX ABRASIVES S.A., Luxembourg (LU)

( * ) Notice: Subject to any disclaimer, the term of this patent is extended or adjusted under 35 U.S.C. 154(b) by 693 days.

(21) Appl. No.: 12/516,579

(22) PCT Filed: Dec. 11, 2007

(86) PCT No.: PCT/IB2007/055019

§ 371 (c)(1),
(2), (4) Date: Aug. 21, 2009

(87) PCT Pub. No.: WO2008/072180

PCT Pub. Date: Jun. 19, 2008

(65) Prior Publication Data

US 2010/0132266 A1 Jun. 3, 2010

(30) Foreign Application Priority Data

Dec. 11, 2006 (ZA) ..... 2006/10343

(51) Int. Cl.

| | |
|---|---|
| ***B24D 3/02*** | (2006.01) |
| ***C09C 1/68*** | (2006.01) |
| ***C09K 3/14*** | (2006.01) |
| ***B24D 3/06*** | (2006.01) |
| ***C22C 26/00*** | (2006.01) |
| *B22F 5/00* | (2006.01) |

(52) U.S. Cl.

CPC ..... *B24D 3/06* (2013.01); *C22C 26/00* (2013.01); *B22F 2005/001* (2013.01)

(58) Field of Classification Search

None

See application file for complete search history.

(56) References Cited

U.S. PATENT DOCUMENTS

| | | | | |
|---|---|---|---|---|
| 3,868,234 | A * | 2/1975 | Fontanella | 51/309 |
| 3,918,931 | A | 11/1975 | De Vries et al. | |
| 4,619,698 | A | 10/1986 | Ueda et al. | |
| 5,096,465 | A | 3/1992 | Chen et al. | |
| 5,271,749 | A * | 12/1993 | Rai | B24D 3/06 51/293 |

(Continued)

FOREIGN PATENT DOCUMENTS

| | | |
|---|---|---|
| DE | 198 45 151 A | 4/2000 |
| EP | 1112815 A2 * | 7/2001 |

(Continued)

OTHER PUBLICATIONS

English language machine translation of JPH 08126903 (A) to Yamamoto.*

(Continued)

*Primary Examiner* — Kaj K Olsen
*Assistant Examiner* — Ross J Christie
(74) *Attorney, Agent, or Firm* — Frommer Lawrence & Haug LLP

(57) ABSTRACT

A cubic nitride compact having a polycrystalline mass of cubic boron nitride particles, present in an amount of at least 70 percent by volume and a binder phase, which is metallic in character. In addition, a compact in which the binder phase is preferably superalloy in character.

8 Claims, 2 Drawing Sheets

XRD scan of the alloy composition used in sintering of Material J

(56) References Cited

U.S. PATENT DOCUMENTS

| | | | | |
|---|---|---|---|---|
| 5,697,994 | A * | 12/1997 | Packer et al. | 51/309 |
| 6,013,117 | A | 1/2000 | Ederyd | |
| 6,478,832 | B2 * | 11/2002 | Miura et al. | 51/307 |
| 2001/0005664 | A1 * | 6/2001 | Miura et al. | 451/41 |
| 2002/0077054 | A1 * | 6/2002 | Sung | B01J 3/062 451/540 |
| 2003/0084894 | A1 * | 5/2003 | Sung | B01J 3/062 451/533 |
| 2004/0228694 | A1 * | 11/2004 | Webb | B23B 27/145 407/113 |
| 2005/0014010 | A1 * | 1/2005 | Dumm et al. | 428/472 |
| 2005/0187093 | A1 * | 8/2005 | McHale et al. | 501/96.4 |
| 2005/0241239 | A1 * | 11/2005 | Sung | B24D 7/14 51/308 |
| 2006/0042172 | A1 * | 3/2006 | Sung | C09K 3/1463 51/309 |
| 2006/0220280 | A1 * | 10/2006 | Sutaria et al. | 264/640 |
| 2007/0134494 | A1 * | 6/2007 | Dole et al. | 428/403 |

FOREIGN PATENT DOCUMENTS

| | | | | |
|---|---|---|---|---|
| JP | 58-60679 | A | | 1/1983 |
| JP | 58003903 | | | 1/1983 |
| JP | 63-72843 | A | | 4/1988 |
| JP | 2-282445 | A | | 11/1990 |
| JP | 04026555 | A | * | 1/1992 |
| JP | 7034156 | | | 2/1995 |
| JP | 7-316839 | A | | 12/1995 |
| JP | 08126903 | A | * | 5/1996 |
| JP | 2001246566 | A | * | 9/2001 |
| WO | WO 96/31305 | A | | 10/1996 |
| WO | WO 2005121402 | A1 | * | 12/2005 |
| WO | WO 2006114682 | A2 | * | 11/2006 |
| WO | WO 2007049140 | A2 | * | 5/2007 |

OTHER PUBLICATIONS

English translation of Office action issued by Chinese Patent Office for corresponding Chinese application 200780045918.6 dated May 23, 2011.

Jianbing, Zang et al.: Structure and properties of $Si_3N_4$ bond polycrystalline cubic boron nitride toughened with $ZrO_2$ ($Y_2O_3$), *Chinese Journal of Materials Research*, vol. 14, No. 6 in Chinese.

Jianbing, Zang et al.: Structure and properties of $Si_3N_4$ bond polycrystalline cubic boron nitride toughened with $ZrO_2$ ($Y_{20}O_3$), *Chinese Journal of Materials Research*, vol. 14, No. 6 English Translation.

Official action issued by Japanese Patent Office in corresponding Japanese application 2009-540942 dated Jan. 25, 2013 with English translation.

* cited by examiner

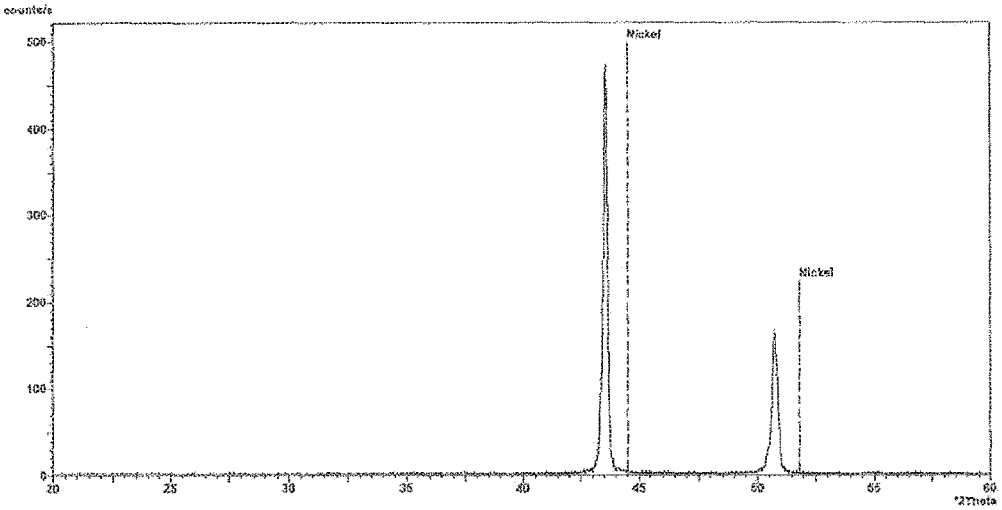
Figure 1 : XRD scan of the alloy composition used in sintering of Material J
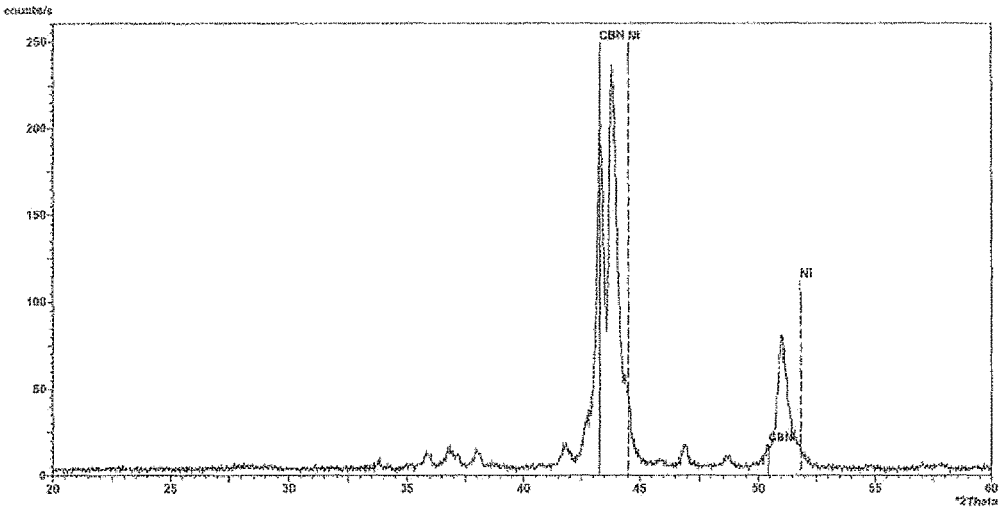
Figure 2 : XRD scan of sintered CBN composite material, Material J

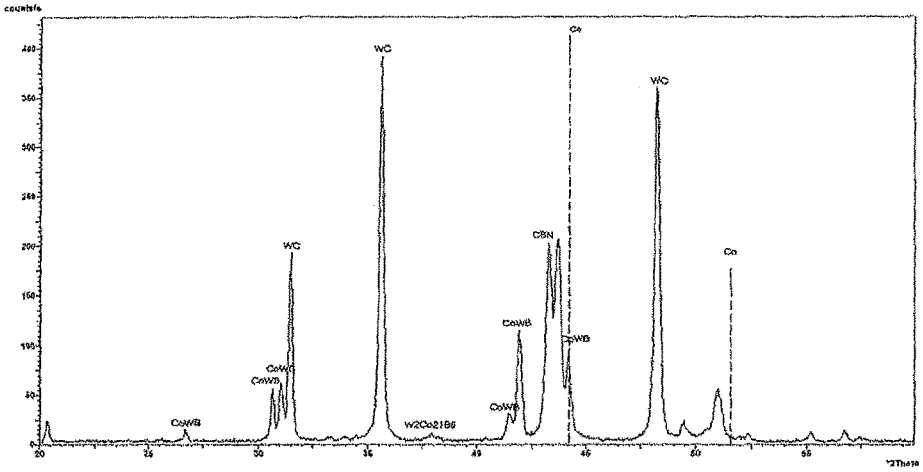
Figure 3 : XRD scan of the sintered CBN composite material. Material B

CUBIC BORON NITRIDE COMPACTS

This application is a 371 of PCT/IB2007/055019 filed on Dec. 11, 2007, published on Jun. 19, 2008 under publication number WO 2008/072180 A and claims priority benefits of South African Patent Application No. 2006/10343 filed Dec. 11, 2006, the disclosure of which is incorporated herein by reference.

BACKGROUND OF THE INVENTION

This invention relates to cubic boron nitride (CBN) abrasive compacts.

Boron nitride exists typically in three crystalline forms, namely cubic boron nitride (CBN), hexagonal boron nitride (hBN) and wurtzitic cubic boron nitride (wBN). Cubic boron nitride is a hard zinc blend form of boron nitride that has a similar structure to that of diamond. In the CBN structure, the bonds that form between the atoms are strong, mainly covalent tetrahedral bonds.

CBN has wide commercial application in machining tools and the like. It may be used as an abrasive particle in grinding wheels, cutting tools and the like or bonded to a tool body to form a tool insert using conventional electroplating techniques.

CBN may also be used in bonded form as a CBN compact, also known as PCBN (polycrystalline CBN). CBN compacts comprise sintered masses of CBN particles. When the CBN content is at least 70 volume % of the compact, there is a considerable amount of CBN-to-CBN contact. When the CBN content is lower, e.g. in the region of 40 to 60 volume % of the compact, then the extent of direct CBN-to-CBN contact is limited.

CBN compacts will generally also contain a binder which is essentially ceramic in nature. When the CBN content of the compact is less than 70 volume %, the matrix phase, i.e. the non-CBN phase, will typically also comprise an additional or secondary hard phase, which is usually also ceramic in nature. Examples of suitable ceramic hard phases are carbides, nitrides, borides and carbonitrides of a Group 4, 5 or 6 (according to the new IUPAC format) transition metal aluminium oxide and mixtures thereof. The matrix phase constitutes all the ingredients in the composition excluding CBN.

CBN compacts tend to have good abrasive wear resistance, are thermally stable, have a high thermal conductivity, good impact resistance and have a low coefficient of friction when in sliding contact with a workpiece. The CBN compact, with or without a substrate (the substrate having been integrally bonded to the PCBN layer during the sintering process) is often cut into the desired size and/or shape of the particular cutting or drilling tool to be used and then mounted on to a tool body utilizing brazing techniques.

CBN compacts may be mechanically fixed directly to a tool body in the formation of a tool insert or tool. However, for many applications it is preferable that the compact is bonded to a substrate/support material, forming a supported compact structure, and then the supported compact structure is mechanically fixed to a tool body. The substrate/support material is typically a cemented metal carbide that is bonded together with a binder such as cobalt, nickel, iron or a mixture or alloy thereof. The metal carbide particles may comprise tungsten, titanium or tantalum carbide particles or a mixture thereof.

A known method for manufacturing the polycrystalline CBN compacts and supported compact structures involves subjecting an unsintered mass of CBN particles together with a powdered matrix phase, to high temperature and high pressure (HpHT) conditions, i.e. conditions at which the CBN is crystallographically or thermodynamically stable, for a suitable time period.

Typical conditions of high temperature and pressure which are used are temperatures in the region of 1100° C. or higher and pressures of the order of 2 GPa or higher. The time period for maintaining these conditions is typically about 3 to 120 minutes.

CBN compacts with CBN content of at least 70 volume % are known as high CBN PCBN materials. They are employed widely in the manufacture of cutting tools for machining of grey cast irons, white cast irons, powder metallurgy steels, tool steels and high manganese steels. In addition to the conditions of use, such as cutting speed, feed and depth of cut, the performance of the PCBN tool is generally known to be dependent on the geometry of the workpiece and in particular, whether the tool is constantly engaged in the workpiece for prolonged periods of time, known in the art as "continuous cutting", or whether the tool engages the workpiece in an intermittent manner, generally known in the art as "interrupted cutting".

Typically high CBN PCBN materials are used in roughing and finishing operations of grey cast irons, white cast irons, high manganese steels and powder metallurgy steels.

After extensive research in this field it was discovered that these different modes of cutting, machining operations and different type of workpiece materials place very different demands on the PCBN material comprising the cutting edge of the tool. Typically a PCBN material for high performance in these application areas should have high abrasive wear resistance, high impact resistance, high thermal conductivity, good crater wear resistance and high heat resistance, i.e. able to maintain these properties at high temperatures. The cutting tool tip can reach temperatures around 1100° C. during machining.

The combination of properties that provide for the above-mentioned behaviours in application can only be achieved by a material that has a high CBN content, higher than 70 volume % and a binder phase that will form a high strength bond with CBN, high toughness and that will retain its properties at high temperatures.

A conventional PCBN material design approach for high CBN content PCBN materials has been to use metal-based starting materials to react with the CBN and to form stable ceramic compounds as the binder phase. The high pressure and high temperature sintered PCBN material is practically pore-free and is ceramic in nature. Ceramic materials are known to have high abrasive wear resistance, high thermal conductivity, good crater wear resistance but they lack impact resistance as a result of their inherent brittleness.

The main problem is that the tools tend to fail catastrophically by fracturing or chipping mainly due to weakness in the binder phase, exacerbated by an increasing demand in the market for higher productivity. This typically results in a reduced life of the tool which necessitates regular replacement of the tool. This in turn, typically results in an increase in production costs, which is undesirable.

CBN is the most critical component of the high CBN content PCBN materials. It provides hardness, strength, toughness, high thermal conductivity, high abrasion resistance and low friction in sliding contact with iron bearing materials. The main function of the binder phase is therefore to provide high strength bonding to the CBN grains in the structure and to complement CBN properties in the composite, particularly in compensating for the brittleness of the CBN phase.

It is desirable to develop improved CBN-based materials that function more efficiently e.g. that exhibit improved abrasive wear resistance, thermal conductivity, impact resistance and heat resistance.

SUMMARY OF THE INVENTION

According to the present invention, a cubic boron nitride compact (PCBN) comprises a polycrystalline mass of cubic boron nitride particles, present in an amount of at least 70 volume % and a binder phase, which is metallic in character.

Essential to the invention is that the binder phase is metallic in character. In other words, the binder phase is dominantly metallic in nature. Thus, the metal which is present in the composition from which the PCBN is produced persists in essentially metallic form in the final sintered PCBN material.

Typically, at least 50, more preferably 60, volume % of the binder phase is metal.

The binder phase is preferably such that the compact exhibits magnetic behaviour, such that it has a specific saturation magnetization of at least $0.350\times10^3$ Weber.

According to a preferred form of the invention, the binder phase is one which is superalloy in character. In particular, the binder phase preferably consists essentially of an alloy, containing:

- at least 40, preferably at least 50, weight % of one or more of a first element selected from the group: nickel, iron and cobalt,
- two or more of a second element selected from a first group of alloying elements: chromium, molybdenum, tungsten, lanthanum, cerium, yttrium, niobium, tantalum, zirconium, vanadium, hafnium, aluminium and, titanium. Elements of this group will typically comprise between 5 and 60 weight % of the alloy.

The alloy binder may further contain one or more of a third element selected from a second group of alloying elements: carbon, manganese, sulphur, silicon, copper, phosphorus, boron, nitrogen and tin.

The term "consisting essentially of" as used herein and in the claims means that the binder contains the alloy and any other elements are present in trace or minor amounts only not affecting the essential alloy, preferably superalloy, character of the binder.

Cubic boron nitride compacts containing the preferred superalloy character defined above have a characteristic binder structure such that:

- according to X-ray diffraction analysis; the highest intensity diffraction peak, (other than CBN) is a metallic peak corresponding to the dominant Co, Fe or Ni alloy component. This peak is displaced no more than 1.5 degree 2θ on either side of the pure Co, Ni or Fe highest intensity diffraction peak.
- according to elemental analysis (using characterization methods such as X-ray fluorescence and Energy Dispersive Spectroscopy), the binder phase further contains detectable levels of at least two or more of second elements defined above. When present, one or more of the third elements will also be detectable.

The binder phase preferably also contains a small amount of a suitable oxide. The oxide, when present, is preferably dispersed through the binder phase and is believed to assist in ensuring that the binder phase properties are enhanced, particularly the high temperature properties. Examples of suitable oxides are selected from rare earth oxides, yttrium oxide, Group 4B, 5B, 6B-oxides according to the IUPAC Periodic Table, aluminium oxide, silicon oxide, and silicon-aluminium-nitride-oxide, known as SIALON. The oxide phase is preferably finely divided and is typically present as particles that are sub-micron in size.

The oxide, when present, is preferably present in an amount of less than 5 percent by mass of the combination of binder phase and oxide. The minor amount of oxide present in the binder phase does not affect the metallic nature or character of the binder phase. Any other ceramic phases are present in trace amounts only, again not affecting the essentially metallic nature or character of the binder phase.

The cubic boron nitride compact typically comprises 70 to 95 volume % CBN, preferably 70 to 90, and most preferably 75 to 85 volume % CBN. Typically CBN average grain size ranges from submicron to about 10 μm. Coarser cBN grain sizes, optionally with multimodal size distributions, may be used.

According yet further to the invention, a composition suitable for making a cubic boron nitride compact (PCBN) comprises a particulate mass of cubic boron nitride particles, a particulate metallic binder and optionally a suitable oxide having a particle size which may be sub-micron, i.e. 1 μm or smaller, the oxide when present being present in an amount of less than 5% by mass of the combination of metallic binder and oxide. The oxide is preferably an oxide as described above.

The particulate metallic binder preferably comprises the metallic components required for making an alloy which is a superalloy in character.

According to another aspect of the invention, a cubic boron nitride compact (PCBN) is produced by subjecting a composition as described above to conditions of elevated temperature suitable to produce a compact from the composition.

BRIEF DESCRIPTION OF THE DRAWINGS

FIGS. 1 and 2 are XRD scans of an alloy composition and a sintered PCBN produced from such an alloy composition, respectively.

FIG. 3 is a reference XRD scan of the sintered composition of a prior art PCBN material.

DETAILED DESCRIPTION

The present invention relates to CBN compacts, more specifically; to a CBN compact comprising polycrystalline CBN and a binder phase which is essentially metallic in character and preferably a superalloy in character and optionally a small amount of a suitable oxide, preferably yttrium oxide.

The compact is a high CBN PCBN material where the CBN content is a most critical component and provides hardness, strength, toughness, high thermal conductivity, high abrasion resistance and low friction coefficient in contact with iron bearing materials. The cubic boron nitride compact typically comprises 70 to 95 volume % CBN, preferably 70 to 90, and most preferably 75 to 85 volume % CBN. If the CBN content is above 95 volume %, the binder phase cannot effectively form high strength bonding with the CBN particles because of the formation of a high fraction of brittle ceramic reaction products. On the other hand, if the CBN content is less than 70 volume %, the dominantly metallic binder phase interacts with iron-based workpiece material, reducing cutting efficiency and increasing abrasive, adhesive and chemical wear.

Another essential feature of the invention is the binder phase which is dominantly metallic in nature. Preferably, the binder phase has a metallurgy that is superalloy in character.

Superalloys are a specific class of iron, nickel, cobalt alloys that are designed for high temperature and corrosion resistant applications. They have not previously been known to be used as a binder system for PCBN. This binder phase preferably comprises a metal alloy or mixture of chemically uniform composition within the structure of the polycrystalline CBN, thereby improving the overall properties of the material.

It is the presence of such a binder phase that provides the CBN compact with its excellent properties of heat resistance, abrasion resistance and impact resistance.

The binder phase preferably consists essentially of an alloy containing:

- at least 40 mass % of one or more of a first element selected from the group: nickel, iron and cobalt,
- two or more second elements selected from the alloying elements: chromium, molybdenum, tungsten, lanthanum, cerium, yttrium, niobium, tantalum, zirconium, vanadium, hafnium, aluminium and titanium.

The alloy binder may further contain one or more of a third element selected from a second group of alloying elements: carbon, manganese, sulphur, silicon, copper, phosphorus, boron, nitrogen and tin.

The cubic boron nitride compact of this invention may be made by subjecting a composition comprising particulate cubic boron nitride particles, a chosen metallic binder in particulate form, and optionally a suitable oxide to elevated temperature and pressure conditions suitable to produce a compact. Typical conditions of high temperature and pressure (HpHT) which are used are temperatures in the region of 1100° C. or higher and pressures of the order of 2 GPa or higher, more preferably 4 GPa or higher. The time period for maintaining these conditions is typically about 3 to 120 minutes.

Additional metal or metal alloy may infiltrate the unbonded composition from another source during compact manufacture. The other source of metal or metal alloy will typically contain a metal such as iron, nickel or cobalt from a cemented carbide substrate on a surface of which the composition is placed prior to the application of the high temperature and pressure conditions.

The CBN compacts of this invention will typically exhibit the following characteristics of the binder phase:

Dominantly Metallic Character

CBN compacts of this invention have a binder that is dominantly metallic in character. Contrary to most high CBN content PCBN materials known in the art, the metallic binder phase materials in the starting or unsintered mixture of this invention do not react markedly with CBN particles at HpHT conditions to produce dominant ceramic phases such as nitrides and borides in situ.

The prior art reaction route for producing PCBN results in a binder phase which is dominantly ceramic in character: for example, in an aluminium metal based binder system (such as that described in U.S. Pat. No. 4,666,466) the aluminium metal reacts almost entirely with CBN to produce a binder system that comprises aluminium nitrides and borides. This type of reaction process and its resultant products have been seen to be critical in producing a well-sintered or cemented PCBN material. The resultant ceramic phases will typically have physical and chemical properties that are far more desirable in a PCBN composite structure than the metallic phases that were introduced prior to sintering. Hence, a binder phase that has a dominantly metallic character present in the starting material which persists in the sintered PCBN is usually seen as undesirable because:

- these metals will not typically have the appropriate wear resistance to form a dominant part of the PCBN material without adversely affecting performance;
- and because persistence of metals will typically indicate incomplete reaction with the CBN particles; and hence insufficient bonding between the CBN and binder phase Without wishing to be bound by theory, it has been postulated that the metallic character of the binder phase in this invention, particularly in its preferred forms, can be accommodated because of the inclusion of alloying elements that react sufficiently with the CBN particles to sinter the material effectively. Coincidentally, it was also found that these alloying elements and further additives further improve the properties of the binder, such that they contribute positively to the material properties of the PCBN itself.

The metallic nature of the binder phase can be easily established using a structurally sensitive technique such as X-Ray diffraction analysis. Where the simple elemental presence of metals is not indicative of their speciation, X-Ray diffraction can be used to identify the structural i.e. metallic nature of the key elements of the binder such as Fe, Ni and/or Co.

Hence standard X-Ray diffraction analysis of the CBN compact materials of this invention, in their preferred forms, shows a strong binder peak corresponding to at least one of the metallic phases of Fe, Ni or Co. This will be the dominant metal in the alloy. The peak for this metal component will hence be the strongest peak observed, aside from the CBN peak. Structural shifts associated with alloying with other elements and reactions with CBN that occur within the binder system will typically cause slight displacement of this peak to either lesser or greater values of $2\theta$ relative to the pure metal reference. This displacement will be less than 1.5 degrees $2\theta$, more preferably less than 1.0 degree $2\theta$ in either direction from the pure metal peak.

Presence of Further Alloying Materials

A further preferred requirement of the binder phase metallurgy is that it contains at least two second elements selected from the group: chromium, molybdenum, tungsten, lanthanum, cerium, yttrium, niobium, tantalum, zirconium, vanadium, hafnium, aluminium and titanium. The cumulative weight percentage of these additives will typically be between 5 and 60 weight % of the binder alloy.

The presence of these elements can be easily identified using a suitable elemental analysis technique such as X-ray fluorescence or Energy Dispersive Spectroscopy.

The binder alloy may further contain at least one additional alloying element selected from the group: carbon, manganese, sulphur, silicon, copper, phosphorus, boron, nitrogen and tin.

Magnetic Character

It is well known that iron, nickel, cobalt and some of the rare earths (gadolinium, dysprosium) exhibit a unique magnetic behaviour which is called ferromagnetism. Materials may be classified by their response to externally applied magnetic fields as diamagnetic, paramagnetic, or ferromagnetic. These magnetic responses differ greatly in strength. Diamagnetism is a property of all materials and opposes applied magnetic fields, but is very weak. Paramagnetism, when present, is stronger than diamagnetism and produces magnetization in the direction of the applied field, and proportional to the applied field. Ferromagnetic effects are very large, producing magnetizations sometimes orders of magnitude greater than the applied field and as such are much larger than either diamagnetic or paramagnetic effects.

The PCBN of the invention contains a binder phase which is metallic in character—preferably containing substantial amounts of one or more of iron, nickel and cobalt. The PCBN will thus typically exhibit magnetic behaviour, such that it has a specific saturation magnetization of at least $0.350\times10^3$ Weber.

The specific saturation magnetization characterizes a ferromagnetic phase and it is in principle independent of the structure and shape of the sample. When a ferromagnetic material is in a magnetic field, it is magnetized. The value of its magnetization increases with the applied field and then, it reaches a maximum. The specific saturation magnetization is the ratio of the maximum of the magnetic moment by the mass of the material. The determination of the magnetic moment is achieved by driving the sample out of a magnetic field and measuring the induced e.m.f. (electromotive force) in a coil. The integral is proportional to the specific saturation magnetization value of the sample, provided that it was saturated in the field.

Optional Presence of a Finely-Divided Oxide

It has also been found that PCBN materials of the invention may be further improved through the addition of a small amount of a suitable finely-divided oxide. The oxide, when present, is usually evenly dispersed through the binder phase and is believed to assist in ensuring that the binder phase properties are enhanced, particularly the high temperature properties.

Examples of suitable oxides are selected from rare earth oxides, yttrium oxide, Group 4B, 5B, 6B-oxides according to the IUPAC Periodic Table, aluminium oxide, silicon oxide, and silicon-aluminium-nitride-oxide, known as SIALON. The oxide phase is typically present as particles that are sub-micron in size. Preferred levels for the oxide addition are less than 5 weight % (of the binder); and more preferably less than 3 weight % (of the binder).

The cubic boron nitride compact of the invention is typically used in machining of hard ferrous materials such as: grey cast irons, high chromium white cast irons, high manganese steels and powder metallurgy steels.

The invention will now be described in more detail with reference to the following non-limiting examples.

EXAMPLES

Example 1

Improved Performance of Materials of the Invention

Material A

An alloy powder was attrition milled with about 1 weight % submicron (i.e. 75 nanometers) $Y_2O_3$ powder. The composition of the alloy powder was as follows:

| | Element | | | | | |
|---|---|---|---|---|---|---|
| | Ni | Cr | Al | Mo | Nb | Ti |
| Mass % | 75 | 12 | 5.9 | 4.5 | 2 | 0.6 |

The alloy powder has a starting particle size distribution such that 80 volume % of particles were below 5 μm. Subsequently, the powder mixture was high speed shear-mixed in ethanol with CBN powder having an average particle size of 2 μm to produce a slurry. The overall CBN content in the mixture was about 93 volume %. The CBN-containing slurry was dried under vacuum and formed into a green compact on a cemented carbide substrate. After vacuum heat treatment, the green compact was sintered at about 5.5 GPa pressure and about 1450° C. to produce a polycrystalline CBN compact bonded to a cemented carbide substrate. This CBN compact is hereinafter referred to as Material A.

Material B: Comparative Example

Cobalt, aluminium, tungsten powders, with the average particle size 1 μm, 5 μm and 1 μm, respectively, were ball milled with CBN. Cobalt at 33 weight %, aluminium at 11 weight %, and tungsten at 56 weight %, form the binder mixture. Cubic boron nitride (CBN) powder of about 1.2 μm in average particle size was added in to the binder mixture at a ratio to achieve 92 volume % CBN. The powder mixture was ball milled with hexane for 10 hours using cemented carbide milling media. After attrition milling, the slurry was dried under vacuum and formed into a green compact supported by a cemented carbide substrate. The material was sintered at about 5.5 GPa and at about 1480° C. to produce a polycrystalline CBN compact. This CON compact is hereinafter referred to as Material B.

A sample piece was cut using wire EDM or Laser from each of Materials A, and B and ground to form cutting inserts. The cutting inserts were tested in continuous finish turning of K190™ sintered PM tool steel. The workpiece material contained fine Cr-carbides which are very abrasive on PCBN cutting tools. The tests were undertaken in dry cutting conditions with the cutting parameters as follows:

| | |
|---|---|
| Cutting speed, vc (m/min) | 150 |
| Depth of cut, (mm) | 0.2 |
| Feed, f (mm) | 0.1 |
| Insert geometry | SNMN 090308 T0202 |

The cutting inserts were tested to the point of failure as a result of excessive flank wear (measured as Vb-max). These tests were conducted at a minimum of three different cutting distances. It was found that, in general, the relationship between flank wear and cutting distance was linear. A maximum flank wear of 0.3 mm was selected as the failure value for the test. Overall cutting distance was then calculated from the normalized maximum flank wear results at 0.3 mm.

TABLE 1

Continuous finish turning results

| Sample | Normalised Cutting distance [m] |
|---|---|
| Material A | 1040 |
| Material B (Prior art) | 940 |

According to results from Table 1, the polycrystalline CBN compacts, Material A produced from a composition which is superalloy in character had a longer tool life than the polycrystalline CBN compact, Material B, produced from a prior art composition.

Example 2

Suitability of Various Alloy Systems

Sample C

Two different alloy powders (in an approximately 50/50 weight ratio) were attrition-milled with about 1 weight % submicron $Y_2O_3$ powder. The composition of the first alloy powder was the same as the alloy powder used for Material A. The composition of the second alloy powder was as follows:

| Element | Co | W | C |
|---|---|---|---|
| Mass % | 70 | 29 | 1 |

Subsequently, the powder mixture was high speed shear-mixed in ethanol with CBN powder having about a 1.2 μm average particle size to produce a slurry. The overall CBN content in the mixture was about 82 volume %. The CBN containing slurry was dried under vacuum and formed into green compact. After vacuum heat treatments, the green compact was sintered at about 5.5 GPa pressure and about 1450° C. to produce a polycrystalline CBN compact. This CBN compact is hereinafter referred to as Material C. A sample piece was cut using wire EDM or Laser from Material C and tested as per the testing method used in Example 1, Table 2 shows the results of this when compared with those of the prior art sample, Material B.

TABLE 2

| Continuous finish turning results | |
|---|---|
| Sample | Normalised Cutting distance [m] |
| Material B (Prior art) | 940 |
| Material C | 998 |

According to results from Table 2, the polycrystalline Material C produced from a composition which is superalloy in character had a longer tool life than the polycrystalline CBN compact, Material B, produced from a prior art composition.

Sample D

An alloy powder was attrition-milled for about 4 hours with hexane and dried. Subsequently, the powder was high speed shear-mixed in ethanol with CBN powder having about a 1.2 μm average particle size producing a slurry. The overall CBN content in the mixture was 93.3 volume %. The composition of the alloy powder was as follows:

| | Element | | | | | | | |
|---|---|---|---|---|---|---|---|---|
| | Ni | Cr | Co | Ti | Al | Fe | Si | Mn |
| Mass % | 60 | 18 | 15 | 2.0 | 1.5 | 1.5 | 1 | 1 |

The CBN containing slurry was dried under vacuum and formed into a green compact on a cemented carbide substrate. After vacuum heat treatment, the green compact was sintered at about 5.5 GPa pressure and about 1450° C. to produce a polycrystalline CBN compact bonded to a cemented carbide substrate. This CBN compact is hereinafter referred to as Material D.

Material E

Material E was produced in the same way as Material A, except without the addition of finely-divided oxide particles; and with an alloy composition as follows:

| | Elements | | | | | | | | | |
|---|---|---|---|---|---|---|---|---|---|---|
| | Ni | Cr | Co | Ti | Mo | Ta | Al | W | Zr | C |
| Mass % | 54.4 | 16 | 14.8 | 5 | 3 | 3 | 2.5 | 1.25 | 0.03 | 0.02 |

A sample piece was cut using wire EDM or Laser from each of Materials B, D and E, and ground to form cutting inserts. The prepared cutting inserts were subjected to a continuous finish turning of Vanadis 10™ sintered and cold worked tool steel. The workpiece material contained abrasive Cr, Mo and V-carbides and considered to be very abrasive on PCBN cutting tools. The tests were undertaken in dry cutting conditions with the cutting parameters as follows:

| | |
|---|---|
| Cutting speed, vc (m/min) | 140 |
| Depth of cut, (mm) | 0.2 |
| Feed, f (mm) | 0.1 |
| Insert geometry | SNMN 090308 T0202 |

Maximum flank wear was measured after cutting distance of 850 m.

TABLE 3

| Continuous finish turning results on Vanadis 10 ™ | |
|---|---|
| Sample | Flank Wear [mm] |
| Material B (Prior art) | 0.220 |
| Material D | 0.210 |
| Material E | 0.203 |

According to results from Table 3, the two polycrystalline CBN compacts, Material D and E, produced from a composition which is superalloy in character had a lower wear scar size and hence a better performance than the polycrystalline CBN compact, Material B, produced from a prior art composition.

Example 3

Demonstration of the Typical Magnetic Character of the Binder

Material F

Material F was prepared the same way as Material C in Example 2 except that the second alloy powder was replaced by cobalt powder with average particle size of 1 μm.

Material G

Material G was prepared the same way as Material A in Example 1 except the average CBN particle size was 1.2 μm.

A sample piece was cut using wire EDM or laser from Materials B, C from Examples 1 and 2; and from Materials F and G. Those sample pieces, containing cemented carbide support layers, were further processed by removing the cemented carbide layers using a wire EDM machining and the cut surface was lapped to remove EDM surface damage.

Specific saturation magnetization ($o_s$) values for Materials B, C, F and G were measured using a measurement set up "Sigmameter D6025 TR". Multiple measurements were taken and the standard deviation of the measurements obtained is summarized in Table 4.

TABLE 4

| Specific saturation magnetisation measurement results | | |
|---|---|---|
| | $\sigma_s$ ($10^3$ Wb) | |
| Sample | Average | Standard deviation |
| Material C | 0.661 | 0.0004 |
| Material F | 1.011 | 0.0000 |
| Material G | 0.380 | 0.0000 |
| Material B (Prior art) | 0.100 | 0.0000 |

The example Materials C, F, G had metallic character containing substantial amounts of nickel and cobalt in alloy form when compared with the prior art material, Material B, which had a predominantly ceramic binder phase. According to Table 2, Materials C, F and G had much higher specific saturation magnetization due to their binder phase being of metallic character when compared with prior art material, Material B.

Example 4

X-Ray Diffraction Characteristic of Binder

Material H

An alloy powder was attrition milled for about four hours using hexane and dried. Subsequently, the powder was high speed shear mixed with CBN powder having about a 1.3 μm average particle size producing a slurry. The overall CBN content in the mixture was about 85 volume percent. The composition of the alloy powder was as follows:

| | Element | | | | | | | |
|---|---|---|---|---|---|---|---|---|
| | Ni | Cr | Co | Ti | Al | Fe | Si | Mn |
| Mass % | 60 | 18 | 15 | 2.0 | 1.5 | 1.5 | 1 | 1 |

The CBN containing slurry was dried under vacuum and formed into a green compact. After vacuum heat treatment, the green compact was sintered at about 5.5 GPa pressure and about 1400° C. to produce a polycrystalline CBN compact. This CBN compact is hereinafter referred to as Material H.

Material I

Material I was prepared the same way as Material H, except that the composition of the alloy powder was as follows:

| | Element | | | | | | | | | | | | |
|---|---|---|---|---|---|---|---|---|---|---|---|---|---|
| | Ni | Cr | Co | Mo | Ti | Fe | Al | Mn | Si | Cu | Zr | C | S |
| Mass % | 54.4 | 19 | 13.5 | 4.3 | 3 | 2 | 1.4 | 1 | 0.75 | 0.5 | 0.07 | 0.06 | 0.02 |

Material J

Material J was prepared the same way as Material H, except that the composition of the alloy powder was as follows:

| | Elements | | | | | | | | | |
|---|---|---|---|---|---|---|---|---|---|---|
| | Ni | Cr | Co | Ti | Mo | Ta | Al | W | Zr | C |
| Mass % | 54.4 | 16 | 14.8 | 5 | 3 | 3 | 2.5 | 1.25 | 0.03 | 0.02 |

Material K

Material K was prepared the same way as Material H except that the composition of the alloy powder was as follows:

| | Elements | | | | | | |
|---|---|---|---|---|---|---|---|
| | Co | Mo | Cr | Si | Ni | Fe | C |
| Mass % | 48.1 | 28 | 18 | 2.8 | 1.52 | 1.5 | 0.08 |

X-ray examination of the CBN compact materials produced was then carried out using a vertical diffractometer fitted with Cu radiation with generator settings of 40 kV and 45 mA.

Typically XRD scans were carried out with a step size of 0.02 degrees 2θ and 5 seconds per step analysis time. Intensities and peak positions of the highest intensity peak of alloy before and after sintering were measured compared to highest intensity peak position of Ni, Co or Fe and the difference in peak positions are calculated in degrees 2θ between the highest intensity peak position of base metal in the alloy, i.e., Ni or Co and the position of the highest intensity peak (excluding CBN) of the sintered material.

The results of this analysis are summarized in Table 5. The highest intensity peak position of the alloy shifts slightly after sintering. This shift indicates that some reactions do take place between the alloy and the CBN particles. Where the peak position moves to a higher 2θ value, this may indicate that some of the alloying elements reacted with CBN and/or some of boron and nitrogen may be dissolving in the alloy phase after sintering. However, the X-Ray diffraction analysis shows that the alloy phase initially introduced still persists in the sintered material; and still forms the dominant portion of the binder (as shown by the continuing high peak intensity).

Further, the 2θ position of the highest intensity XRD peaks of the alloy are close to those of the highest intensity peaks for the pure metals. (These values are given for reference in Table 5—if the main constituent of the alloy phase is Ni, then the pure Ni XRD peaks should be used as the reference and so on).

TABLE 5

X-ray analysis of the alloys used in Materials H, I, J and K before and after sintering

| Sample | Peak position (degrees 2θ) Pre-sintering | Post-sintering | Reference | 2-θ difference | Peak intensity (count per second) CBN | Alloy |
|---|---|---|---|---|---|---|
| Material H | 43.85 | 43.95 | 44.51, Ni | −0.56 | 754 | 1091 |
| Material I | 43.69 | 43.93 | 44.51, Ni | −0.58 | 823 | 2164 |
| Material J | 43.57 | 43.83 | 44.51, Ni | −0.68 | 1014 | 2374 |
| Material K | 43.45 | 43.61 | 44.22, Co | −0.61 | 453 | 292 |

All peak positions are quoted in degrees 2θ and intensities are in counts per second FIG. 1 shows the XRD scan of starting alloy powder used in Material J. According to this analysis, alloying is identified as peak shifts from the pure nickel, which is the matrix phase for the alloy and alloying elements causes an XRD peak shift of about 0.68 degrees 2θ from the pure nickel peak position as indicated in Table 5.

FIG. 2 shows the XRD scan of Material J (i.e. post HpHT sintering with CBN). The primary XRD peaks of the superalloy are slightly displaced from the pure Ni peak; and still constitute the highest intensity peaks, apart from CBN, with in the sintered CBN composite material. Further low intensity peaks in FIG. 2 can be ascribed to phases that are formed mainly as a result of interaction of the superalloy with CBN and incidental impurities.

FIG. 3 shows the XRD scan of the sintered prior art Material B, for reference. Whilst metallic cobalt, tungsten and aluminium were introduced into the starting powder in metallic form; the final structure shows significantly reduced presence of these metallic phases; with substantial formation of ceramic phases such as WC, WBCo etc. It is evident from the XRD scan that these non-metallic phases dominate the binder composition.

Example 5

Effect of Sub-Micron Oxide Addition

Material L

Material L was produced in the same manner as Material A, but without the addition of finely-divided oxide particles. An alloy powder content of 7 weight % was used, with the same composition described in Example 1, Material A. Materials A, B (prior art), L and material O (from Example 6) were subjected to the same machining test described in Example 1. Material O was prepared by the same method as Materials A and L; but contains $ZrO_2$ additive.

The performance data in Table 6 indicates that Material L with no oxide additive outperforms the prior art material B, as well as Material A (containing $Y_2O_3$) but not the equivalent sample Material O (containing $ZrO_2$). This indicates that the effect of adding finely-divided oxides on wear resistance may be positive, but in certain cases, may equally have no or a small negative effect. In all cases, the materials of this invention out-performed the prior art material.

TABLE 6

Wear resistance after cutting 1000 m of abrasive workpiece, K190 ™.

| Sample | Additive | Flank Wear [mm] |
|---|---|---|
| Material B | Prior Art | 0.319 |
| Material A | $Y_2O_3$ | 0.288 |
| Material L | No Additive | 0.234 |
| Material O | $ZrO_2$ | 0.229 |

Example 6

Addition of Suitable Finely-Divided Oxides

Materials M to S were prepared in the same way as Material A in Example 1 except with the substitution of an alternative finely-divided oxides of the type and quantity specified below. In each case the oxide was attrition-milled with the alloy powder as was the case in Example 1.

| | Sample M | N | O | P | Q | R | S |
|---|---|---|---|---|---|---|---|
| Oxide | $CeO_2$ | $Al_2O_3$ | $ZrO_2$ | SiAlON | MgO | $CeO_2$ | $La_2O_3$ |
| Size (nm) | 10-20 | 60 | 40 | 75 | 100 | 10-20 | 80 |
| Mass % | 1.3 | 1.3 | 1.3 | 1.3 | 1.3 | 2.7 | 2.7 |

Materials M to S and prior art material, Material B; were then subjected to the same machining test conditions as those described in Example 1. The cutting inserts were tested to cutting distance of about 1000 m and maximum flank wears (Vb-max) measured. The machining test indicates cutting tool performance and ranks the materials in terms of their wear resistance.

As is evident in Table 7, the addition of various amounts and types of oxide phases into the current invention materials resulted in substantial enhancement of wear performance indicated by the measured lower flank wear scar size in Materials M to S when compared to prior art material, Material B.

TABLE 7

Wear resistance after cutting 1000 m of abrasive workpiece, K190 ™.

| Sample | Additive | Flank Wear [mm] |
|---|---|---|
| Material B | Prior Art | 0.319 |
| Material M | $CeO_2$ | 0.237 |
| Material N | $Al_2O_3$ | 0.247 |
| Material O | $ZrO_2$ | 0.229 |
| Material P | SiAlON | 0.226 |
| Material Q | MgO | 0.242 |
| Material R | $CeO_2$ | 0.245 |
| Material S | $La_2O_3$ | 0.259 |

The invention claimed is:

1. A cubic boron nitride compact consisting of:

(a) a polycrystalline mass of cubic boron nitride particles, present in an amount of at least 70 percent by volume;

(b) a binder phase, wherein the binder phase consists of an alloy consisting of at least 40 percent by weight of one or more of a first element selected from the group consisting of nickel, iron and cobalt and the balance of the alloy consisting of two or more of a second element selected from the group consisting of chromium, molybdenum, tungsten, lanthanum, cerium, yttrium, niobium, tantalum, zirconium, vanadium, hafnium, aluminium and titanium, the cumulative weight percentage of the two or more of a second element being 5 to 60 percent by weight; and (c) an oxide, wherein the oxide is: (i) present in an amount of less than 5 percent by mass of a combination of binder and oxide; (ii) selected from rare earth oxides, yttrium oxide, an oxide of a Group 4B, 5B, and 6B metal, silicon oxide, and silicon-aluminium-nitride-oxide, and (iii) dispersed through the binder.

2. A cubic boron nitride compact consisting of:

(a) a polycrystalline mass of cubic boron nitride particles, present in an amount of at least 70 percent by volume;

(b) a binder phase, wherein the binder phase consists of an alloy consisting of at least 40 percent by weight of one or more of a first element selected from the group consisting of nickel, iron and cobalt and the balance of the alloy consisting of (i) two or more of a second element selected from the group consisting of chromium, molybdenum, tungsten, lanthanum, cerium, yttrium, niobium, tantalum, zirconium, vanadium, hafnium, aluminium and titanium, and (ii) one or more of a third element selected from the group consisting of carbon, manganese, sulphur, silicon, copper, phosphorus, boron, nitrogen and tin, the cumulative weight percentage of the two or more of the second element and the one or more of the third element being 5 to 60 percent by weight; and (c) an oxide, wherein the oxide is: (i) present in an amount of less than 5 percent by mass of a combination of binder and oxide; (ii) selected from rare earth oxides, yttrium oxide, an oxide of a Group 4B, 5B, and 6B metal, silicon oxide, and silicon-aluminium-nitride-oxide, and (iii) dispersed through the binder.

3. A cubic boron nitride compact according to claim 1 wherein the alloy consists of at least 50 percent by weight of the first element.

4. A cubic boron nitride compact according to claim 1 wherein the cubic boron nitride (CBN) content of the compact is 70 to 95 volume % CBN.

5. A cubic boron nitride compact according to claim 1 wherein the cubic boron nitride (CBN) content of the compact is 70 to 90 volume % CBN.

6. A cubic boron nitride compact according to claim 1 wherein the cubic boron nitride (CBN) content of the compact is 75 to 85 volume % CBN.

7. A cubic boron nitride compact according to claim 1 wherein the average grain size of the CBN particles does not exceed about 10 microns.

8. A cubic boron nitride compact according to claim 1 wherein the oxide is present as particles that are sub-micron in size.

* * * * *